US010505273B2

(12) United States Patent
Haziza

(10) Patent No.: US 10,505,273 B2
(45) Date of Patent: Dec. 10, 2019

(54) VARIABLE DIELECTRIC CONSTANT ANTENNA HAVING SPLIT GROUND ELECTRODE

(71) Applicant: Wafer LLC, Hanover, NH (US)

(72) Inventor: Dedi David Haziza, Kiryat Motzkin (IL)

(73) Assignee: WAFER LLC, Hanover, NH (US)

( * ) Notice: Subject to any disclaimer, the term of this patent is extended or adjusted under 35 U.S.C. 154(b) by 0 days.

(21) Appl. No.: 16/436,807

(22) Filed: Jun. 10, 2019

(65) Prior Publication Data

US 2019/0296429 A1 Sep. 26, 2019

Related U.S. Application Data

(60) Division of application No. 15/885,680, filed on Jan. 31, 2018, now Pat. No. 10,320,070, which is a continuation-in-part of application No. 15/654,643, filed on Jul. 19, 2017, now Pat. No. 10,326,205.

(60) Provisional application No. 62/431,393, filed on Dec. 7, 2016, provisional application No. 62/382,489, filed on Sep. 1, 2016, provisional application No. 62/382,506, filed on Sep. 1, 2016.

(51) Int. Cl.

| | |
|---|---|
| ***H01Q 1/48*** | (2006.01) |
| ***H01Q 21/06*** | (2006.01) |
| ***H01Q 3/44*** | (2006.01) |
| ***H01Q 1/38*** | (2006.01) |
| *H01Q 21/24* | (2006.01) |
| *H01Q 9/04* | (2006.01) |

(52) U.S. Cl.
CPC ..... *H01Q 1/48* (2013.01); *H01Q 1/38* (2013.01); *H01Q 3/44* (2013.01); *H01Q 21/065* (2013.01); *H01Q 9/0435* (2013.01); *H01Q 21/24* (2013.01)

(58) Field of Classification Search
CPC .. H01Q 1/48; H01Q 1/38; H01Q 3/44; H01Q 21/06; H01Q 9/04; H01Q 21/24
USPC ..... 343/848
See application file for complete search history.

(56) References Cited

U.S. PATENT DOCUMENTS

2013/0207855 A1* 8/2013 Chien ..... H01Q 9/48 343/721
2015/0138036 A1* 5/2015 Harper ..... H01Q 1/48 343/848

* cited by examiner

*Primary Examiner* — Andrea Lindgren Baltzell
(74) *Attorney, Agent, or Firm* — Womble Bond Dickinson (US) LLP; Joseph Bach, Esq.

(57) ABSTRACT

A multi-layer antenna having radiation layer including radiating elements; transmission layer including delay lines for coupling the RF signal to the radiating elements; control layer comprising variable dielectric constant (VDC) plate; RF coupling layer including arrangements for coupling RF signal to each of the delay lines; ground layer functioning as ground for the RF signal. The ground layer may also function as ground for the VDC control signal. The ground plane may comprise a plurality of conductive ground patches, each conductive ground patch separated from a neighboring conductive ground patch by a distance that appears as a break for a square wave signal of up to 400 Hz, but appears as a short for the RF signal. It is beneficial to make the separation not larger than a tenth of the wavelength of the RF signal.

20 Claims, 16 Drawing Sheets

VARIABLE DIELECTRIC CONSTANT ANTENNA HAVING SPLIT GROUND ELECTRODE

RELATED APPLICATIONS

This Application is a divisional of U.S. patent application Ser. No. 15/885,680, filed on Jan. 31, 2018 (now U.S. Pat. No. 10,320,070), which is a continuation-in-part of U.S. patent application Ser. No. 15/654,643, filed on Jul. 19, 2017 (now U.S. Pat. No. 10,326,205), which claims priority benefit from U.S. Provisional Application No. 62/431,393, filed on Dec. 7, 2016, U.S. Provisional Application No. 62/382,489, filed on Sep. 1, 2016, and U.S. Provisional Application No. 62/382,506, filed on Sep. 1, 2016, and is also related to U.S. patent application Ser. No. 15/421,388, filed on Jan. 31, 2017, the disclosures of all of which are incorporated herein by reference in their entireties.

BACKGROUND

1. Field

The disclosed invention relates to radio-transmission and/or reception antennas and methods for manufacturing such antennas and its associated feeding networks, be it microstrip, stripline or other.

2. Related Art

In a prior disclosure, the subject inventor has disclosed an antenna that utilizes variable dielectric constant (VDC) to control the characteristics of the antenna, thereby forming a software defined antenna. Details about that antenna can be found in U.S. Pat. No. 7,466,269, the entire disclosure of which is incorporated herein by reference. The antenna disclosed in the '269 patent proved to be operational and easy to manufactured by simply forming the radiating elements and feeding lines on top of an LCD screen. Therefore, further research has been done to further investigate different possibilities of improving the software defined antennas.

In the parent application the subject inventor has disclosed various embodiments of improved variable dielectric constant antennas. Much of the improvements in those embodiments (the description of which is included herein) reside in the fabrication of multi-layers, thereby separating the various signal paths. Regardless of the particular antenna design, as explained in the '269 patent, the software control of the antenna is done via signals applied to the individual VDC pixels. That means that the controller must be able to address each pixel individually. Also, for cost considerations, it is preferable to utilize a standard controller of an LCD screen, e.g., a controller of a flat panel television.

A conventional flat TV controller sends square-wave signal to the pixels to refresh the image on the screen according to the designed refresh rate. However, a conventional controller issues both a control signal and a ground signal to each pixel. That is, in a conventional TV, each pixel has two electrodes. The controller issues a common and a square wave signal, one applied to the input electrode and one to the ground or common electrode of the pixel. In this manner, the controller can issue these dual-signals serially to each pixel to refresh the entire screen. However, as described in the '269 patent and in the parent application, the ground plane is common to both all of the radiating elements and all of the VDC pixels. This prevents using a standard controller, since the standard controller issues a ground signal separately to each pixel. Therefore, a solution is needed that would enable using a conventional controller, which issues a separate ground signal to each VDC pixel, while maintaining the common ground for all of the radiating elements.

SUMMARY

The following summary is included in order to provide a basic understanding of some aspects and features of the invention. This summary is not an extensive overview of the invention and as such it is not intended to particularly identify key or critical elements of the invention or to delineate the scope of the invention. Its sole purpose is to present some concepts of the invention in a simplified form as a prelude to the more detailed description that is presented below.

This disclosure provides various enhancements and advancement for the variable dielectric constant antenna. Embodiments disclosed herein provide an improved antenna array and method for manufacturing such an antenna array. Additionally, embodiments disclosed herein enable controlling the antenna using standard flat screen controllers to control the VDC pixels. Specifically, the embodiments provide a single ground plane having both common ground for the radiating elements and separate ground for the VDC pixels.

According to disclosed embodiments the ground plane is divided into rows on the DC aspect by forming DC breaks (e.g., by etching or scribing) between the rows. The controller is then energized to send the ground signal to the row of the pixel of interest. The controller is also energized to send the activation signal to the pixel of interest, but send a cancellation signal to the other pixels in that same row. The cancellation signal may be equal to the ground signal applied to that same row. In this manner, the controller can serially activate pixels in row after row. For each row, at each given cycle, only one pixel receives the activation signal while the remaining pixels in the row get the cancellation signal. In the next cycle the activation signal is applied to the next pixel in the row.

According to other embodiments the ground plane is divided into individual patches on the DC aspect. This embodiment can be compared to a chocolate bar—from the RF aspect, the entire bar is one connected piece, but from the DC aspect there are separate islands. According to this embodiment, the ground of each pixel can be addressed individually.

Various disclosed embodiments provide an antenna having split ground plane. The antenna comprises an insulating substrate; a plurality of radiating patches provided on top surface of the insulating substrate; a plurality of pixels of variable dielectric constant material; and a ground plane coupled to the plurality of radiating patches and to a pixel controller, the ground plane comprising a plurality of DC breaks dividing the ground plane into a plurality of DC island separated by DC break sized to enable capacitive coupling of RF signal among the DC islands. In one embodiment the DC breaks form rows or columns, while in another embodiment the DC breaks form both rows and columns, providing a separate DC ground for each radiating patch of the plurality of radiating patches. In one embodiment the DC breaks form rows of DC ground, each row being separately coupled to a ground signal of a pixel controller.

Disclosed embodiment provide a multi-layer antenna comprising: a radiating layer comprising a plurality of radiating patch provided on a top surface of the insulating spacer and arranged in an array of row and columns; a transmission layer comprising a plurality of delay lines arranged in an array of row and columns, each delay line being coupled to a corresponding one of the radiating patches; a control layer comprising a variable dielectric constant (VDC) plate; an RF coupling arrangement for coupling RF signal to each of the radiating patches; and, a ground layer comprising a plurality of conductive ground patches, each conductive ground patch separated from a neighboring conductive ground patch by a distance not larger than a tenth of the wavelength of the RF signal. Each of the conductive ground patches may be aligned below a row of the delay lines or below a single one of the delay lines. Each of the conductive ground patches is separately coupled to a common signal output of a controller, and all of the conductive ground patches cooperatively form a common ground for the RF signal. Each of the conductive ground patches may further comprise at least one aperture aligned below one of the conductive delay lines Various disclosed embodiments provide an antenna having capacitively coupled feed line and other means to connect the feeding network to the radiating elements, such as vias and proximity coupling. The antenna comprises an insulating substrate; a conductive patch provided on top surface of the insulating substrate; a ground plane provided on bottom surface of the insulating substrate, the ground plane comprising an aperture therein, the aperture being registered to be aligned below the conductive patch; a feed line having terminative end thereof registered to be aligned below the aperture, so as to capacitively transmit RF signal to the conductive patch through the aperture. Other configurations are feasible as well and the following example is set to provide an optional solution and provide an insight on how to implement the system most effectively.

Embodiments of the invention provide a software defined antenna by using a variable dielectric to control a delay line, thereby generating a phase and/or frequency shift. The phase shift may be used, e.g., for spatial orientation of the antenna or for polarization control. Disclosed embodiments decouple the antenna and the corporate feed design so as to avoid signal interference between them. Disclosed embodiments further decouple the RF and DC potentials. The various elements of the antenna, such as the radiator, the corporate feed, the variable dielectric, the phase shift control lines, etc., are provided in different layers of a multi-layered antenna design, thus decoupling the design and avoiding cross-talk.

Various disclosed features include a novel arrangement for coupling the RF signal between the radiating element and the feed line; an arrangement for controlling frequency and phase of the signal; a multi-layered antenna; and methods of manufacturing the antenna.

BRIEF DESCRIPTION OF THE DRAWINGS

The accompanying drawings, which are incorporated in and constitute a part of this specification, exemplify the embodiments of the present invention and, together with the description, serve to explain and illustrate principles of the invention. The drawings are intended to illustrate major features of the exemplary embodiments in a diagrammatic manner. The drawings are not intended to depict every feature of actual embodiments nor relative dimensions of the depicted elements, and are not drawn to scale.

FIG. 3A illustrates a top view of a single radiating element, while

FIG. 6A illustrates a top view of a single radiating element, while FIG. 6E illustrates a rectangular patch that can be used to operate in two different frequencies, while

FIG. 8 illustrates an embodiment with two delay lines connected to a single patch, such that each delay line may carry a different polarization; while FIG. 8A illustrates a variation of the embodiment shown in FIG. 8.

FIG. 9 illustrates an embodiment wherein the VDC plate includes only defined area of VDC material; while

DETAILED DESCRIPTION

Embodiments of the inventive antenna will now be described with reference to the drawings. Different embodiments or their combinations may be used for different applications or to achieve different benefits. Depending on the outcome sought to be achieved, different features disclosed herein may be utilized partially or to their fullest, alone or in combination with other features, balancing advantages with requirements and constraints. Therefore, certain benefits will be highlighted with reference to different embodiments, but are not limited to the disclosed embodiments. That is, the features disclosed herein are not limited to the embodiment within which they are described, but may be "mixed and matched" with other features and incorporated in other embodiments.

As with all RF antennas, reception and transmission are symmetrical, such that a description of one equally applies to the other. In this description it may be easier to explain transmission, but reception would be the same, just in the opposite direction.

The various embodiments described herein provide a multi-layer antenna that can be controlled by a standard or a specially designed flat panel display controller. The antennas include a radiation layer that includes radiating elements for radiating and receiving an RF signal; a transmission layer that includes delay lines for coupling the RF signal to the radiating elements; a control layer comprising a variable dielectric constant (VDC) plate; an RF coupling layer that includes arrangements for coupling RF signal to each of the delay lines; and, a ground layer that functions as ground for the RF signal. In some embodiments the ground layer also functions as ground for the VDC control signal. In embodiments wherein the ground plane functions as ground for the VDC control signal, the ground plane may comprise a plurality of conductive ground patches, each conductive ground patch separated from a neighboring conductive ground patch by a distance that appears as a break for a square wave signal of up to 400 Hz, but appears as a short for the RF signal. In those cases, it is beneficial to make the separation not larger than a tenth of the wavelength of the RF signal.

Figure 1:
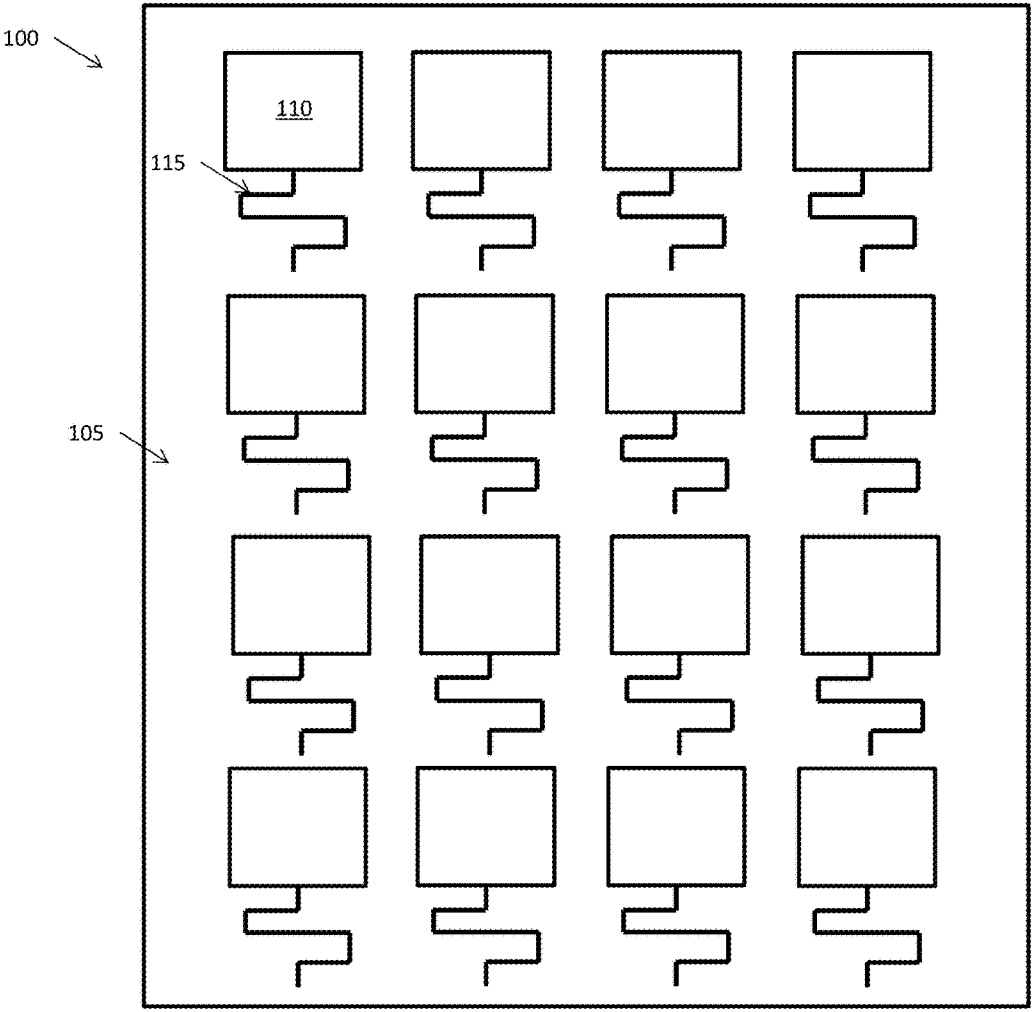
FIG. 1 illustrates a top view of an antenna according to one embodiment.
Figure 1A:
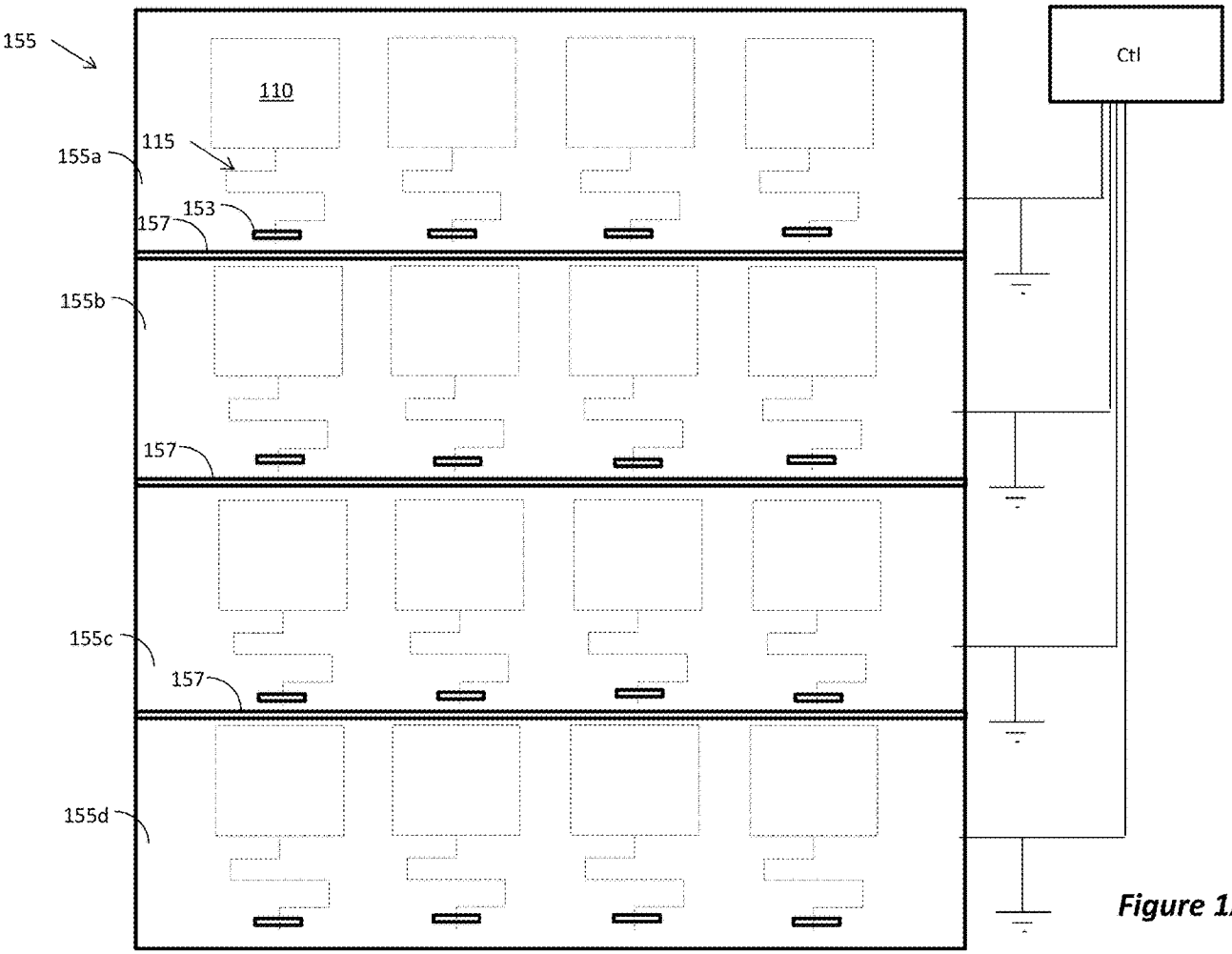
FIGS. 1A-1C and 1E illustrate a top view of a ground plane for an antenna according to disclosed embodiments.
Figure 1B:
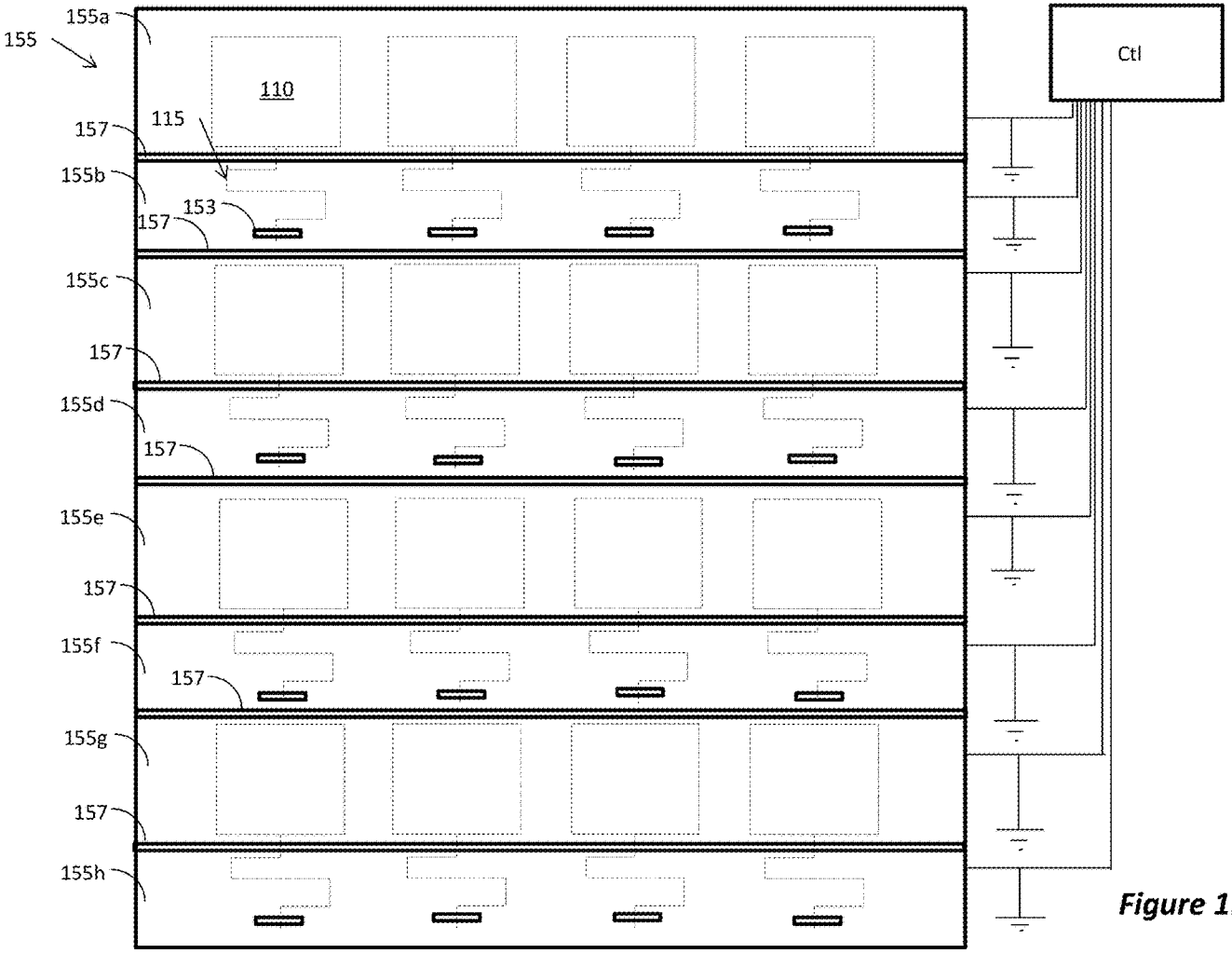
Figure 1C:
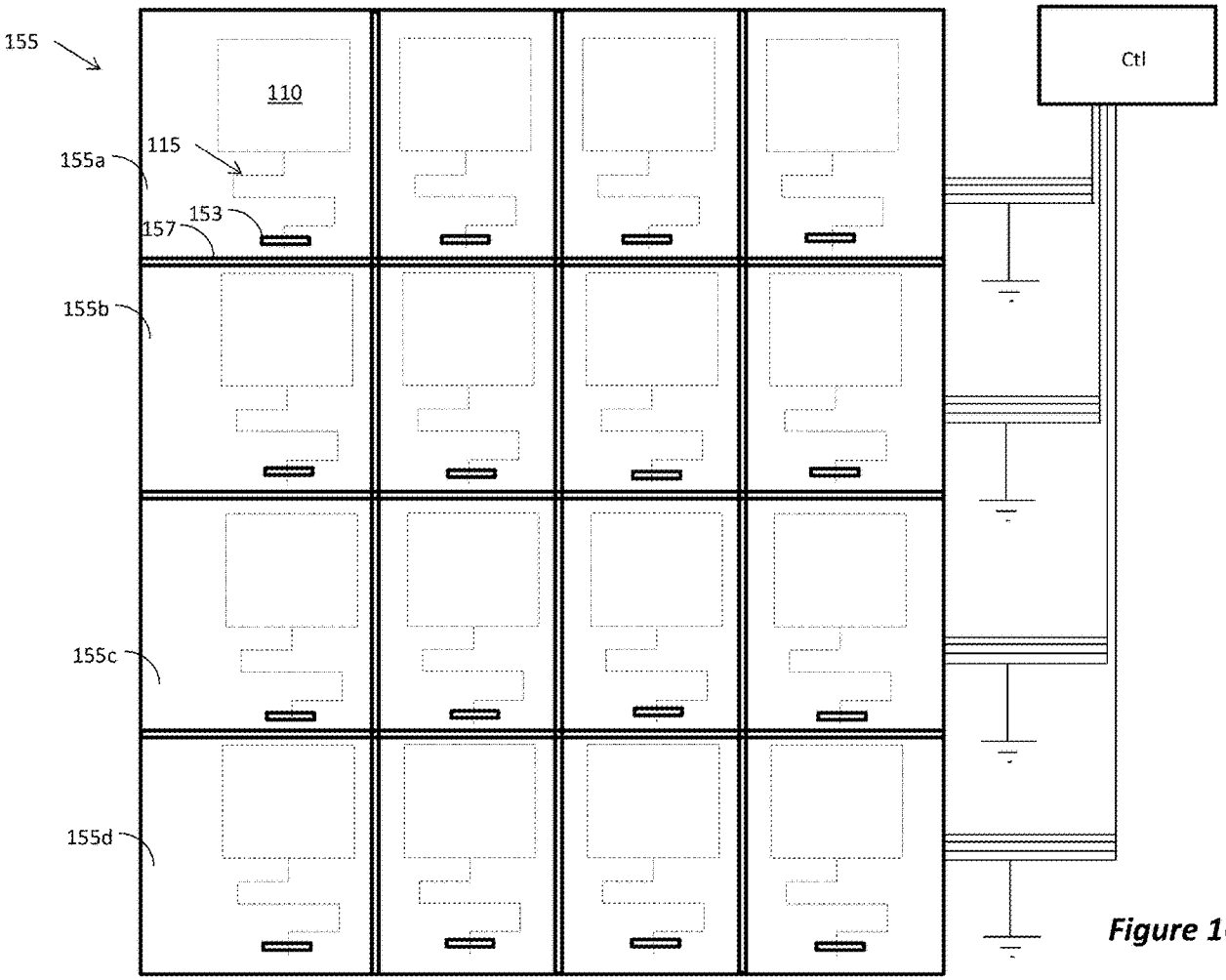
Figure 1D:
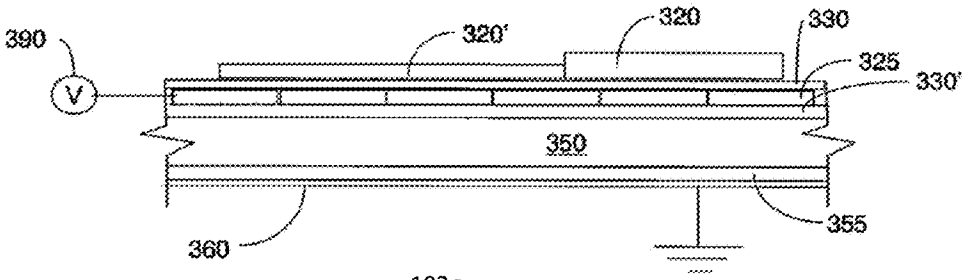
FIG. 1D illustrate a cross-section of an embodiment utilizing a ground plane for an antenna according to any of the disclosed embodiments.
Figure 3A:
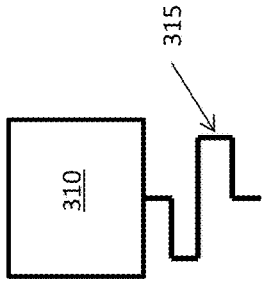
Figure 3B:
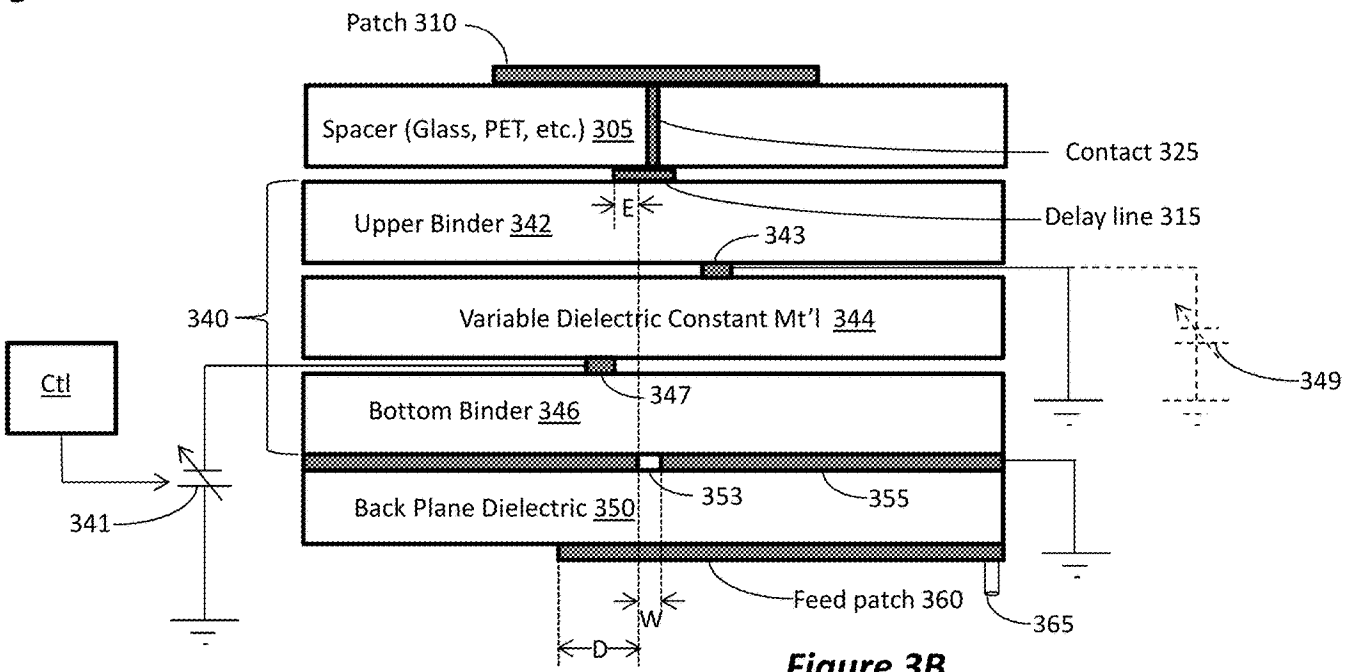
FIG. 3B illustrates a cross section of relevant sections of the antenna at the location of the radiating element of FIG. 3A, according to one embodiment.
Figure 3C:
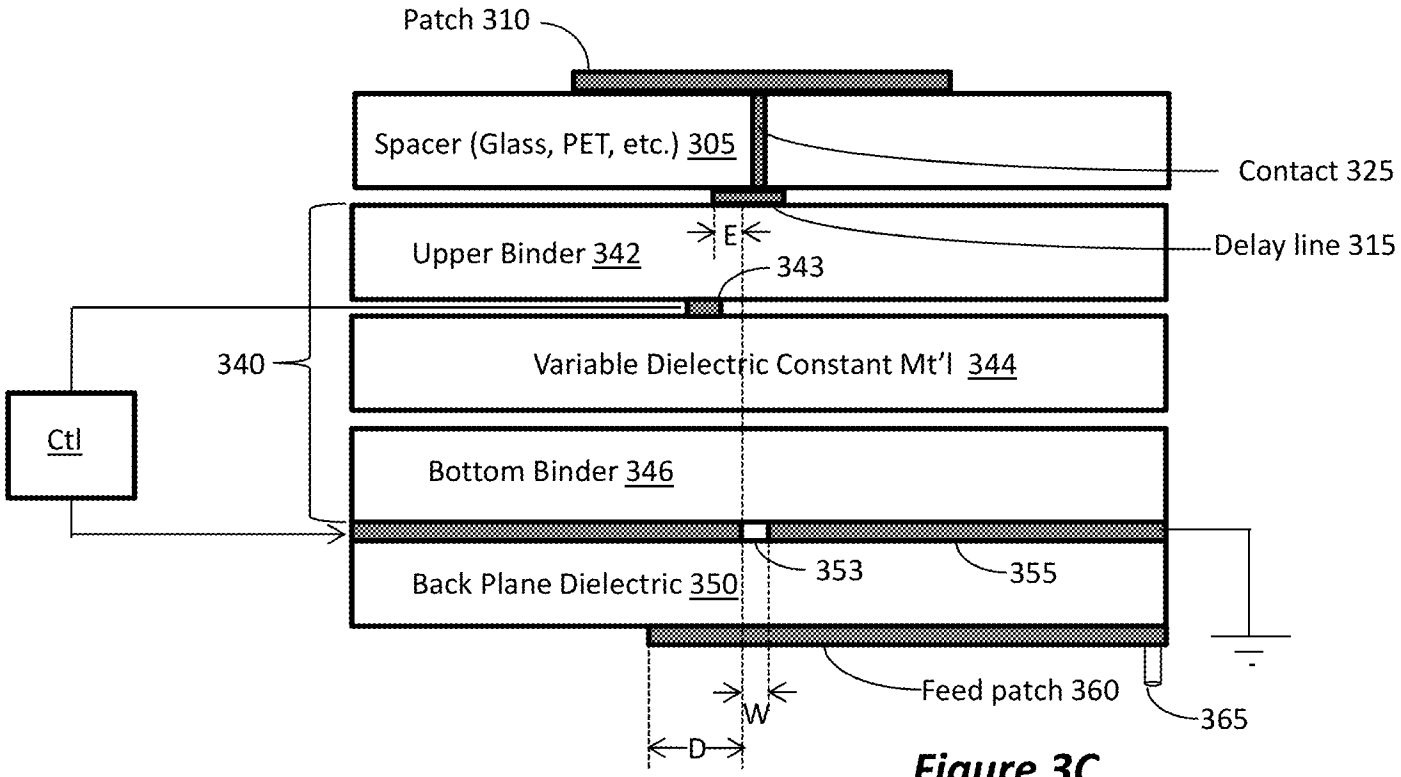
FIG. 3C is a cross-section of a variation of the antenna of FIG. 3B.

FIG. 1D illustrate a cross-section of an embodiment of FIG. 3A-3C of the '269 patent, except that the ground plane 360 is constructed according to embodiments described herein. As described in the '269 patent, radiating element 320 and conductive line 320' are provided over insulating layer 330, which may be a glass panel. The insulating layer 330 is provided over an LCD comprising transparent electrodes 325, upper dielectric plate 330', liquid crystal 350, lower dielectric plate 355, and lower electrode, i.e., ground plane 360. The liquid crystal may be provided in zones, as illustrated by the broken lines, and the zones may correspond to the electrodes 325. According to the '269 patent the lower electrode 360 is coupled to common potential, e.g., ground. However, in this disclosed embodiment the ground plane 360 is split and is connected to multiple ground outputs of the controller, while also coupled to a common RF ground, as will be explained further below. The transparent electrodes 325 can be individually coupled to a potential 390 supplied individually be the controller. When the potential on any of the transparent electrodes 325 changes, the dielectric constant of the liquid crystal below it changes, thereby inducing a phase change in conductive line 320'. The phase change can be controlled by choosing the amount of voltage applied to the transparent electrode 325, i.e., controlling $\varepsilon_r$, and also by controlling the number of electrodes the voltage is applied to, i.e., controlling d.

FIG. 1 illustrates a top view of an antenna 100, according to one embodiment. Generally, the antenna is a multi-layer antenna that includes the patch layer, the true time delay layer, the slotted ground layer and the corporate feed layer, as will be described in more details below. In some instances, additional layers are added, providing multiple polarization, wider bandwidth, etc. The various elements of the antenna may be printed or deposited on the insulating substrates.

As illustrated in FIG. 1, the antenna in this particular example comprises a 4×4 array of radiators 110, although any number of radiators in various geometries and arrangements may be used, and a square arrangement of 4×4 elements is chosen only as one example. In this example each radiator 110 is a conductive patch provided (e.g., deposited, adhered to, or printed) on top of an insulation layer 105 and has a delay feed line 115 coupled to it, either physically or capacitively, as will be explained further below. Each delay feed line 115 is a meandering conductor that provides the RF signal to its corresponding patch 110. The RF signal can be manipulated, e.g., delayed, change frequency, change phase, by controlling a variable dielectric layer positioned under the delay line. By controlling all of the delay lines, the array can be made to point to different directions, as needed, thus providing a scanning array.

Figure 2:
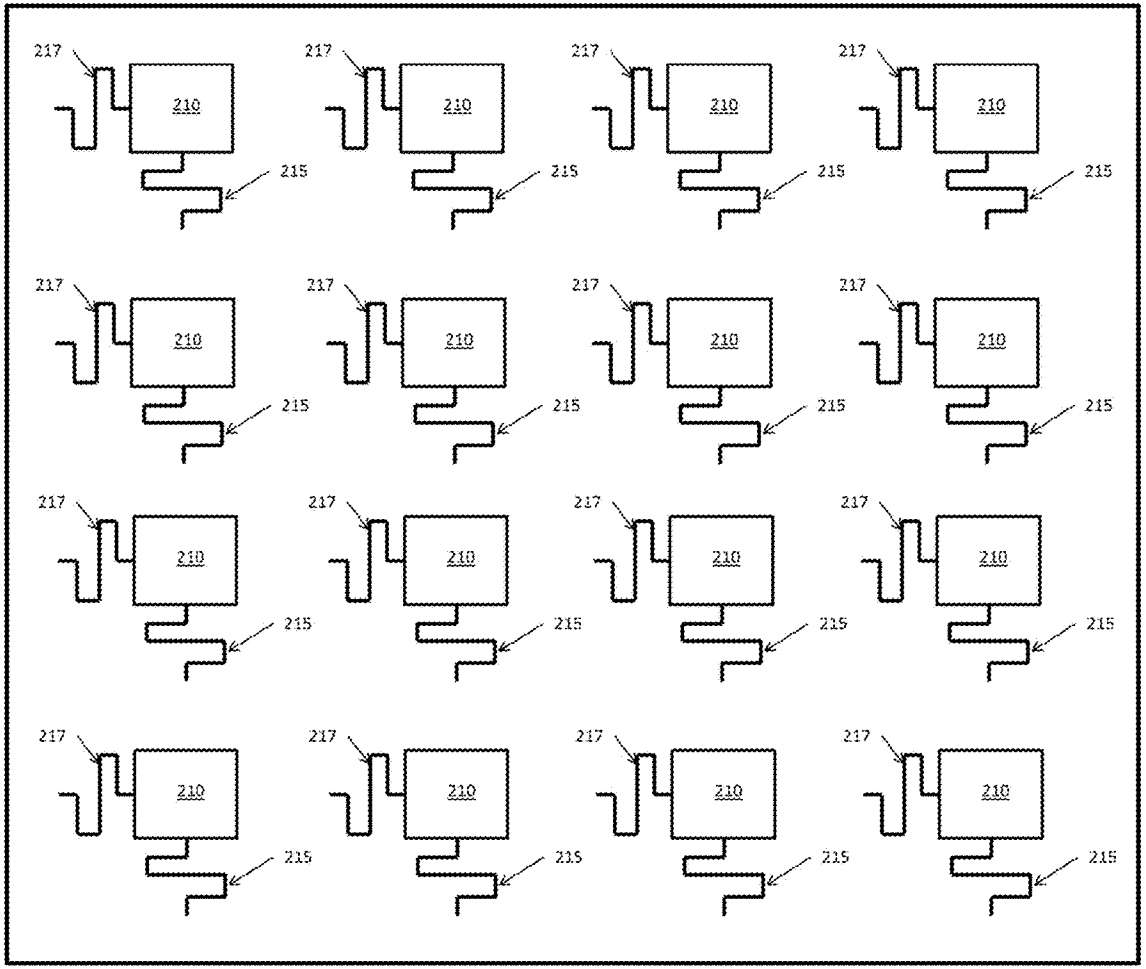
FIG. 2 illustrates a top view of an antenna according to another embodiment, wherein each radiating element can be fed by two orthogonal feed lines.

In FIG. 1 each element is fed from only one feed line 115. However, as illustrated in FIG. 2, each radiating element 210 can be fed by two orthogonal feed lines, 215 and 217, for example, each having different polarization. The description provided herein is applicable to both and any similar, architectures.

Figures 8, 8A:
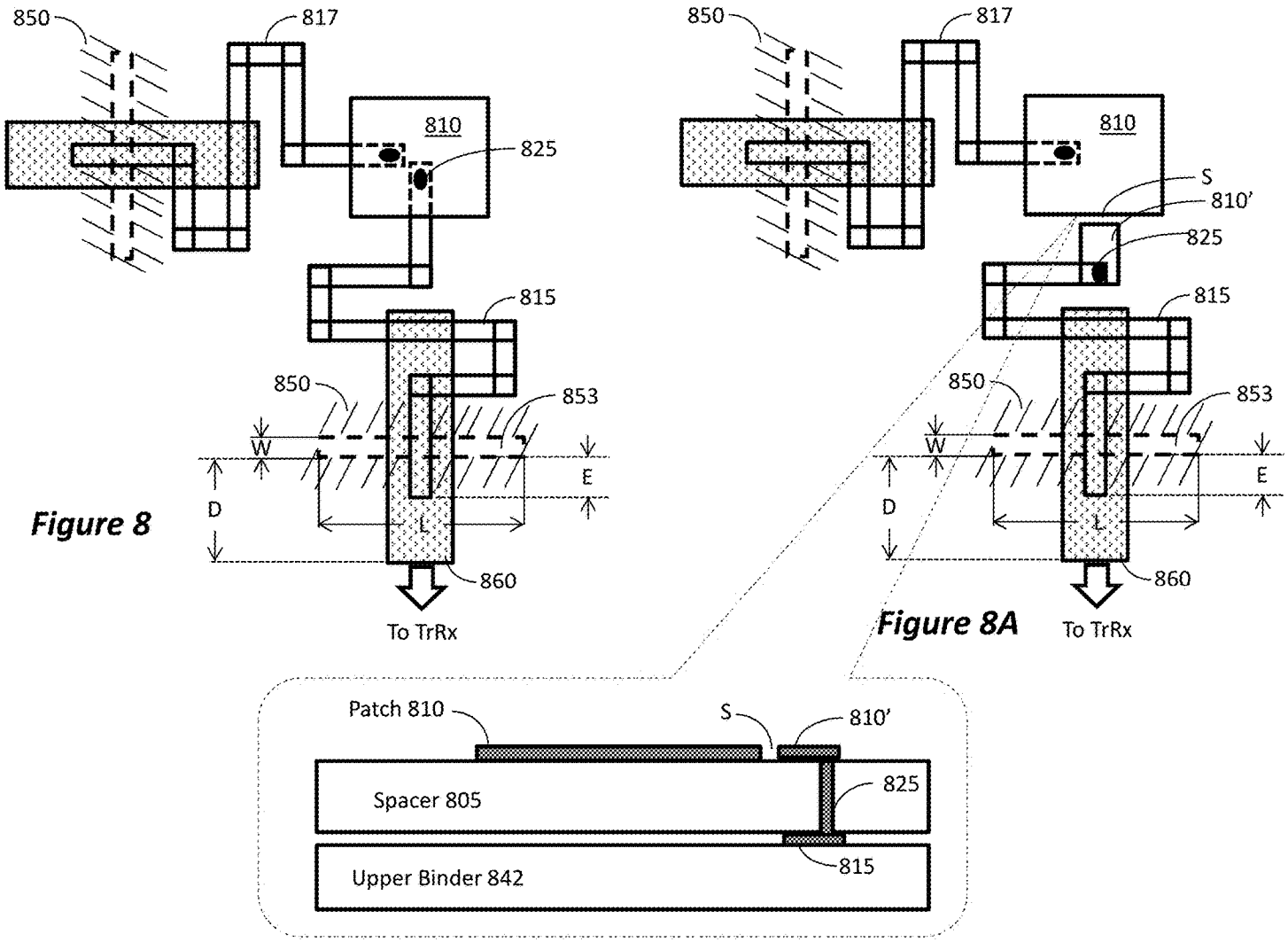

The structure and operation of the antennas shown in FIGS. 1 and 2 can be better understood from the following description of FIGS. 3A and 3B, with further reference to FIG. 8. FIG. 3A illustrates a top view of a single radiating element 310, while FIG. 3B illustrates a cross section of relevant sections of the antenna at the location of the radiating element 310 of FIG. 3A. FIG. 8 provides a top "transparent" view that is applicable to all of the embodiments described herein, including the embodiment of FIGS. 3A and 3B. Thus, in studying any of the embodiments disclosed herein, the reader should also refer to FIG. 8 for a better understanding. Similarly, FIGS. 1A and 1B illustrate embodiments of the ground plane that may be used in any of the embodiments disclosed herein, as well as the embodiments disclosed in the '269 patent.

A top dielectric spacer 305 is generally in the form of a dielectric (insulating) plate or a dielectric sheet, and may be made of, e.g., glass, PET, etc. The radiating patch 310 is formed over the spacer by, e.g., adhering a conductive film, sputtering, printing, etc. At each patch location, a via is formed in the dielectric spacer 305 and is filled with conductive material, e.g., copper, to form contact 325, which connects physically and electrically to radiating patch 310. A delay line 315 is formed on the bottom surface of dielectric spacer 305 (or on top surface of upper binder 342), and is connected physically and electrically to contact 325. That is, there is a continuous DC electrical connection from the delay line 315 to radiating patch 310, through contact 325. As shown in FIG. 3A, the delay line 315 is a meandering conductive line and may take on any shape so as to have sufficient length to generate the desired delay, thereby causing the desired phase shift in the RF signal.

The delay in the delay line 315 is controlled by the variable dielectric constant (VDC) plate 340 having variable dielectric constant material 344. While any manner for constructing the VDC plate 340 may be suitable for use with the embodiments of the antenna, as a shorthand in the specific embodiments the VDC plate 340 is shown consisting of upper binder 342, (e.g., glass PET, etc.) variable dielectric constant material 344 (e.g., twisted nematic liquid crystal layer), and bottom binder 346. In other embodiments one or both of the binder layers 342 and 344 may be omitted. Alternatively, adhesive such as epoxy or glass beads may be used instead of the binder layers 342 and/or 344.

In some embodiments, e.g., when using twisted nematic liquid crystal layer, the VDC plate 340 also includes an alignment layer that may be deposited and/or glued onto the bottom of spacer 305, or be formed on the upper binder 342. The alignment layer may be a thin layer of material, such as polyimide-based PVA, that is being rubbed or cured with UV radiation in order to align the molecules of the LC at the edges of confining substrates.

The effective dielectric constant of VDC plate 340 can be controlled by applying DC potential across the VDC plate 340. For that purpose, electrodes are formed and are connected to controllable voltage potential. There are various arrangements to form the electrodes, and several examples will be shown in the disclosed embodiments. In the arrangement shown in FIG. 3B, two electrodes 343 and 347 and provided—one on the bottom surface of the upper binder 342 and one on the upper surface of the bottom binder 346. As one example, electrode 347 is shown connected to variable voltage potential 341, while electrode 343 is connected to ground. As one alternative, shown in broken line, electrode 343 may also be connected to a variable potential 349. FIG. 3C illustrates a variation wherein the controller issues two signals: a control signal and a ground or common signal. The control signal is applied to the electrode 343, while the common signal is applied to the ground plane 355.

Thus, by changing the output voltage of variable potential 341 and/or variable potential 349, one can change the dielectric constant of the VDC material in the vicinity of the electrodes 343 and 347, and thereby change the RF signal traveling over delay line 315. Changing the output voltage of variable potential 341 and/or variable potential 349 can be done using a controller, Ctl, running software that causes the controller to output the appropriate control signal to set the appropriate output voltage of variable potential 341 and/or variable potential 349. Similarly, a conventional controller can be used to provide the control and common signals to control the characteristics of the antenna, as shown in FIG. 3C. Thus, the antenna's performance and characteristics can be controlled using software—hence software controlled antenna.

At this point it should be clarified that in the subject description the use of the term ground refers to both the generally acceptable ground potential, i.e., earth potential, and also to a common or reference potential, which may be a set potential or a floating potential. For example, conventional LCD display controllers output two signals per pixel, one of which is referred to as the ground or common signal. Similarly, while in the drawings the symbol for ground is used, it is used as shorthand to signify either an earth or a common potential, interchangeably. Thus, whenever the term ground is used herein, the term common or reference potential, which may be set or floating potential, is included therein.

In transmission mode the RF signal is applied to the feed patch 360 via connector 365 (e.g., a coaxial cable connector). As shown in FIG. 3B, there is no electrical DC connection between the feed patch 360 and the delay line 315. However, in disclosed embodiments the layers are designed such that an RF short is provided between the feed patch 360 and delay line 315. As illustrated in FIG. 3B, a back plane conductive ground (or common) 355 is formed on the top surface of backplane insulator (or dielectric) 350 or the bottom surface of bottom binder 346. The back plane conductive ground 355 is generally a layer of conductor covering the entire area of the antenna array. At each RF feed location a window (DC break) 353 is provided in the back plane conductive ground 355. The RF signal travels from the feed patch 360, via the window 353, and is coupled to the delay line 315. The reverse happens during reception. Thus, a DC open and an RF short are formed between delay line 315 and feed patch 360.

In one example the back plane insulator 350 is made of a Rogers® (FR-4 printed circuit board) and the feed patch 360 may be a conductive line formed on the Rogers. Rather than using Rogers, a PTFE (Polytetrafluoroethylene or Teflon®) or other low loss material may be used.

To further understand the RF short (also referred to as virtual choke) design of the disclosed embodiments, reference is made to FIG. 8. FIG. 8 illustrates an embodiment with two delay lines connected to a single patch 810, such that each delay line may carry a different signal, e.g., at different polarization. The following explanation is made with respect to one of the delay lines, as the other may have similar construction.

In FIG. 8 the radiating patch 810 is electrically DC connected to the delay line 815 by contact 825 (the delay line for the other feed is referenced as 817). So, in this embodiment the RF signal is transmitted from the delay line 815 to the radiating patch 810 directly via the contact 825. However, no DC connection is made between the feed patch 860 and the delay line 815; rather, the RF signal is capacitively coupled between the feed patch 860 and the delay line 815. This is done through an aperture in the ground plane 850. As shown in FIG. 3B, the VDC plate 340 is positioned below the delay line 315, but in FIG. 8 it is not shown, so as to simplify the drawing for better understanding of the RF short feature. The back ground plane 850 is partially represented by the hatch marks, also showing the window (DC break) 853. Thus, in the example of FIG. 8 the RF path is radiating patch 810, to contact 825, to delay line 815, capacitively through window 850 to feed patch 860.

For efficient coupling of the RF signal, the length of the window 853, indicated as "L", should be set to about half the wavelength of the RF signal traveling in the feed patch 860, i.e., $\lambda/2$. The width of the window, indicated as "W", should be set to about a tenth of the wavelength, i.e., $\lambda/10$. Additionally, for efficient coupling of the RF signal, the feed patch 860 extends about a quarter wave, $\lambda/14$, beyond the edge of the window 853, as indicated by D. Similarly, the terminus end (the end opposite contact 825) of delay line 815 extends a quarter wave, $\lambda/4$, beyond the edge of the window 853, as indicated by E. Note that distance D is shown longer than distance E, since the RF signal traveling in feed patch 860 has a longer wavelength than the signal traveling in delay line 815.

It should be noted that in the disclosure, every reference to wavelength, $\lambda$, indicates the wavelength traveling in the related medium, as the wavelength may change as it travels in the various media of the antenna according to its design and the DC potential applied to variable dielectric matter within the antenna.

As explained above, in the example of FIG. 8 the RF signal path between the delay line and the radiating patch is via a resistive, i.e., physical conductive contact. On the other hand, FIG. 8A illustrates a variation wherein the RF signal path between the delay line and the radiating patch is capacitive, i.e., there's no physical conductive contact between them. As shown in FIG. 8A and its callout, a coupling patch 810' is fabricated next to the radiating patch 810. The contact 825 forms physical conductive contact between the delay line 815 and coupling patch 810'. The coupling of the RF signal between the radiating patch 810 and the coupling patch 810' is capacitive across the short dielectric space S. The space S may be simply air or filled with other dielectric material. While in FIG. 8A only delay line 815 is shown capacitively coupled to the radiating patch 810, this is done for illustration only, and it should be appreciated that both delay lines 815 and 817 may be capacitively coupled to the radiating patch 810.

Turning to FIG. 1A, it depicts a top view of a ground plane 155 according to one embodiment. In FIG. 1A the radiating patches 110 and the delay lines 115 are illustrated in dotted lines to enable the reader to orient the elements of the ground plane. The ground plane 155 illustrated in FIG. 1A may be implemented with any of the other embodiments disclosed herein, including the modified embodiment of the '269 patent, as described herein.

The embodiment of the ground plane 155 illustrated in FIG. 1A is particularly useful when utilizing a flat panel display controller (Ctl) to control the VDC pixels of the antenna. The controller may be any standard controller that sends a control and a common signal to activate the pixels, e.g., model ZEDV04-E-A from American Zettler Displays, model CBC-2 from Amulet Technologies, model 4171300XX-3 from Digital View, etc. Such conventional display controllers operate the refresh the image on the display by sending a common signal to a row of pixels and then serially issuing an activation signal to each pixel in the row. Then it issues a common signal to the next row and serially issues an activation signal to each pixel in the next row. Using the embodiment of FIG. 1A the controller can be used in a similar manner to control the pixels of the antenna.

In general, the ground plane 155 may simply be a plate or a coating of a conductive material, such as copper. The conductive material may cover the entire area of the ground plane layer. Also, as described herein, when desiring to couple the RF signal capacitively, windows 153 may be formed in the ground plane, aligned with the delay lines 115. While for completeness the drawings include the windows 153, the split ground feature disclosed herein may be implemented with or without the coupling windows 153.

In order to utilize a standard controller, Ctl, which sends both a common signal and an activation signal, a split ground feature is implemented in the embodiment of FIG. 1A. Specifically, elongated DC breaks 157 are formed in the ground plane, dividing the ground plane into rows, indicated in FIG. 1A as ground strips 155*a*-155*d*. Each ground strip 155*a*-155*d* is provided under a row of radiating elements and corresponding delay lines. Each ground strip 155*a*-155*d* is independently connected to the controller. Thus, the controller can apply common signal to each of the ground strips 155*a*-155*d* independently. The controller may then apply activation signals serially to the pixels corresponding to the ground strip that receives the common signal.

In this respect it should be noted that for each delay line and/or radiating patch there may be more than one pixel, and thus more than one electrode, requiring the applied activation signal. Nevertheless, all of these pixels, and therefore their corresponding electrodes, would be positioned above the strip that receives the common signal. Conversely, as will be described below, the activation signal may be applied to the delay line, thus activating all of the VDC pixels below the delay line simultaneously. It should also be noted that while in FIG. 1A the ground strips are shown in a "row" orientation, the same effect can be obtained by arranging the ground strips in "column" orientation.

A feature of the split ground is that it is accomplished using DC breaks sized to appear as continuity for the RF signal. That is, while the breaks 157 provide isolation for DC signal and for the relatively low frequency square wave of the controller (normally 50 Hz-400 Hz), it appears as a short for the high frequency RF signal. Consequently, the same ground plane can be used as ground for the RF signal and as common for the pixel control. To accomplish forming a DC break that appears as a short to the RF ground signal, the width of the DC break should not be more than $\lambda/10$, with respect to the wavelength of the RF signal traveling in the conductive material.

Thus, embodiments of the invention provide an antenna comprising: an insulating substrate; a plurality of conductive patches provided on top surface of the insulating substrate; a variable dielectric constant (VDC) plate; a plurality of conductive delay lines provided over the VDC plate, each of the delay lines coupling RF signal to one of the plurality of conductive patches; and a ground plane provided below the VDC plate, the ground plane comprising at least one DC break sized to form a short for ground path of the RF signal. The VDC plate may define a plurality of VDC pixels, and the antenna may further comprise at least one activation electrode corresponding to each of the plurality of VDC pixels. Each of the plurality of delay line may comprise activation signal input configured for receiving activation signal from a controller. Each radiating patch may include a conductive stub, each conductive stub being coupled to activation signal line of a controller. Each of the elongated rows is independently coupled to a common signal output of a controller.

The ground plane may comprise a plurality of elongated DC breaks dividing the ground plane to a plurality of ground strips. Similarly, the ground plane may comprise a plurality of DC breaks, each traversing the entire ground plane, thus dividing the ground plane into a plurality of physically separated ground patches. The width of the DC break is not more than $\lambda/10$ with respect to the wavelength of the RF signal. The ground plane may further comprise a plurality of apertures, each aperture being aligned below one of the conductive delay lines. The ground plane may comprise a plurality of DC breaks, each traversing the entire ground plane, thus dividing the ground plane into a plurality of elongated rows, each row being aligned below a row of conductive delay lines.

The split ground embodiment shown in FIG. 1A is but one example, but many other designs can be implemented to suit different applications. To illustrate, a couple more examples are discussed below.

FIG. 1B illustrates an example wherein the ground plane is split to provide separate ground strips (155*a*-155*h*) for the radiating patches and the delay lines. In one example, such an arrangement can be used to separately activate VDC pixels below the patches (e.g., to change resonance frequency) and VDC pixels below the delay lines (e.g. to cause scanning or steering of the array). This can be done by the same of a different controller.

FIG. 1C, on the other hand, illustrates an example wherein each unit of radiating patch and corresponding delay line is provided its own separate ground patch. Using such an arrangement, the VDC pixels of each unit can be controlled independently by receiving separate activation and common signals. In FIG. 1C four ground lines are shown terminating at each row, to indicate that each of the ground patch in the row is connected individually to the controller.

Figure 1E:
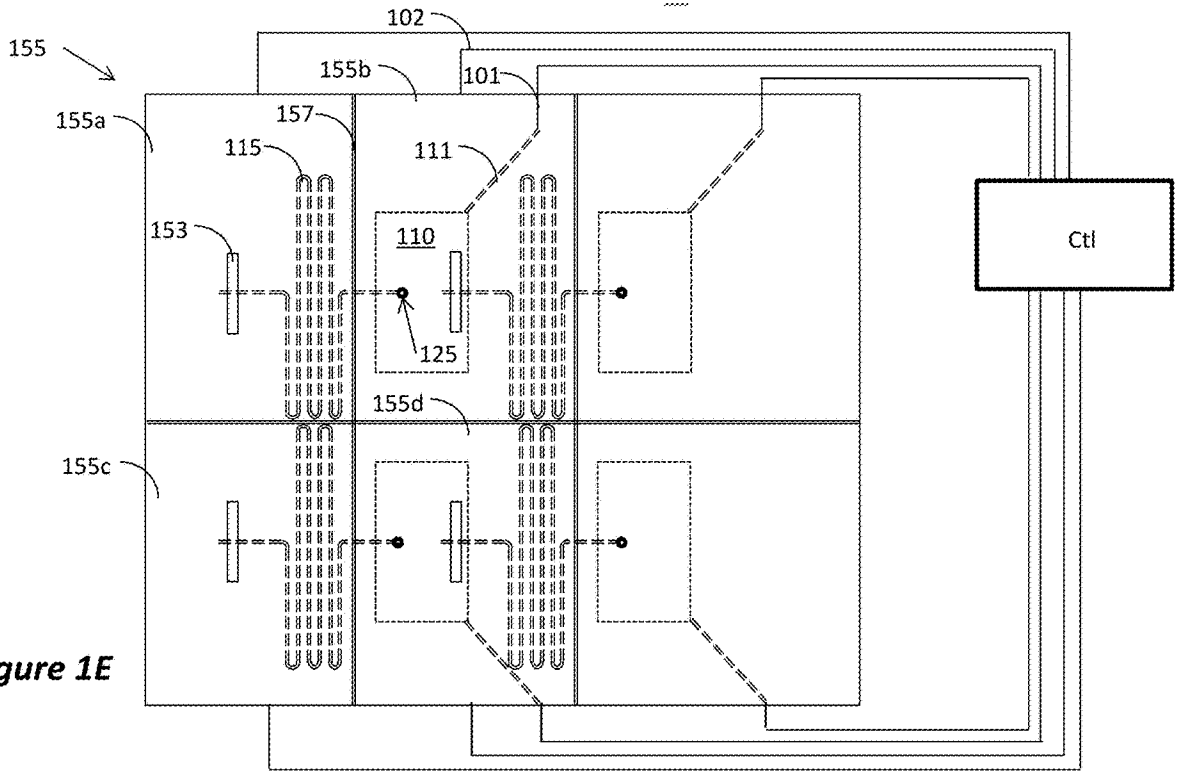

According to embodiments of the invention the split lines can be aligned between the radiating patch and a corresponding delay line. Such an example is illustrated in FIG. 1E, showing a split ground plane for an antenna array of 2×2 radiating elements 110. The radiating patches 110 and delay lines 115 are shown in dotted lines, as they are in a different layer than the ground plane 155. Also, to enable better orientation of the reader, the contact 125 between the radiating patch and corresponding delay line is illustrated as a circle. In this embodiment the ground plane includes DC breaks 157 that pass below and in alignment between the radiating element 110 and its corresponding delay line 115, thus creating ground patches 155*a*-155*d*, wherein a ground patch, e.g., 155*b* and 155*d*, covers an area that encompass a radiating patch and a delay line connected to another radiating patch that overlays a different ground patch.

Also, in the embodiment of FIG. 1E a cross DC break is also provided, thus creating a separate ground patch below each of the delay lines. Consequently, the common signal can be delivered independently to each ground path of a specific delay line. Optionally the coupling windows 153 are also provided in order to couple the RF signal to the delay lines.

Moreover, in the embodiment of FIG. 1E each patch includes a conductive stub 111. Each conductive stub 111 is connected to an activation signal line 101 of the controller. Thus, when a controller applies an activation signal to one of the activation signal lines 101, the signal is transmitted via the activation signal line 101 to the stub 111, thence to the radiating patch 110, thence through the contact 125 to the delay line. As the ground patch below that delay line receives the common signal, the VDC material between the ground patch and the delay line would be activated.

Any of the embodiments of the split ground plane described herein may be fabricated by various methods. For example, the ground plane may be first fabricated as one large conductive coating, e.g., by sputtering or coating with copper or other conductive material. Thereafter the single coating may be etched, scribed, etc., to form the DC breaks. Conversely, the ground plane can be fabricated with the DC breaks, e.g., by using mask during sputtering or coating with copper or other conductor. Alternatively the ground plane may be fabricated as multiple ground patches that are separated from each other by no more than a tenth of the wavelength of the RF signal. The separation distance is configured to appear as a break for a square wave signal of frequency up to 400 Hz, but appear as a short for the RF frequencies of the antenna.

Figure 4:
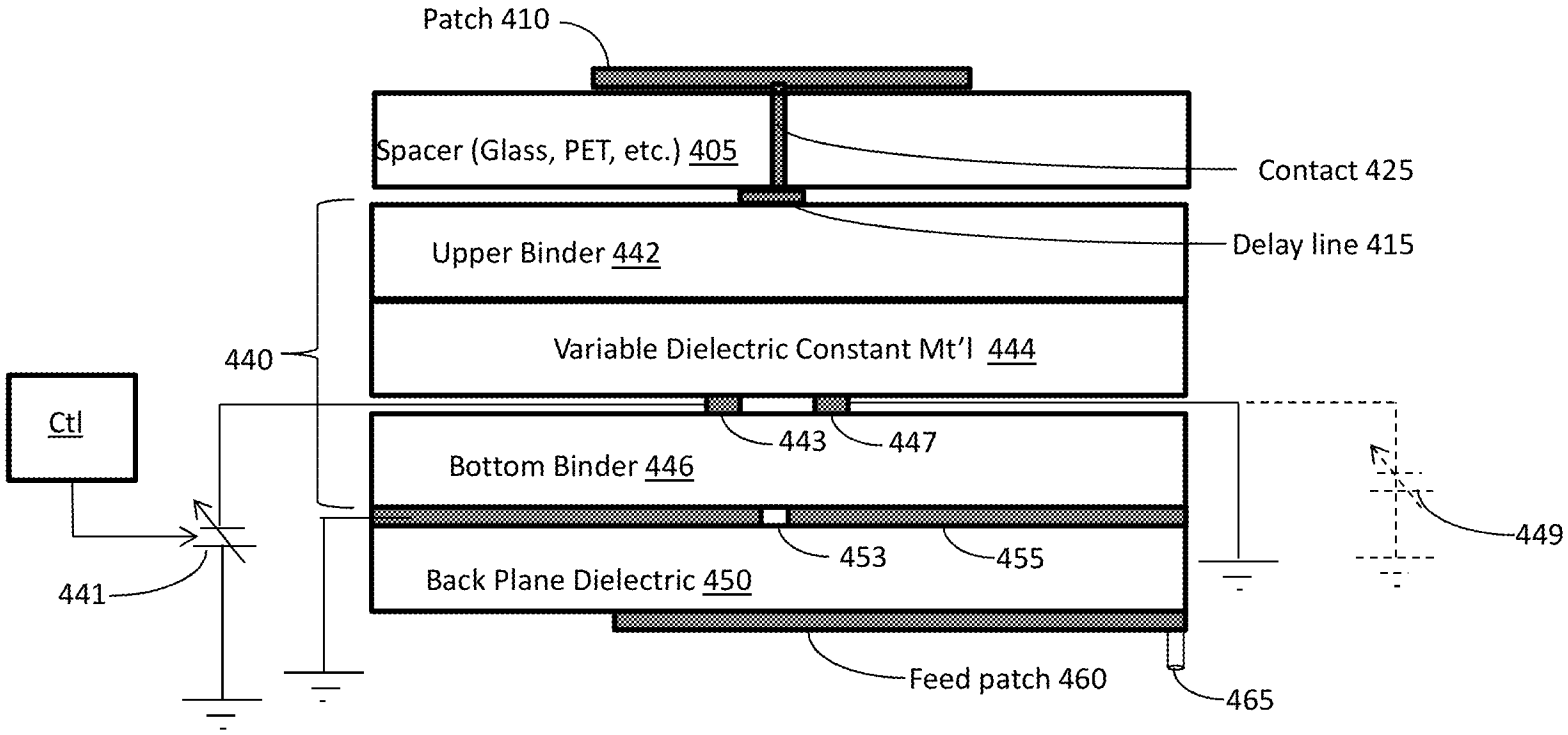
FIG. 4 illustrates a cross section of relevant sections of the antenna at the location of the radiating element according to another embodiment.

FIG. 4 illustrates another embodiment having similar construction to that of FIG. 3B, except for the arrangement for applying DC potential to the variable dielectric constant material 444. In FIG. 4, the two electrodes 443 and 447 are provided side by side, rather than across the layer 444. The electrodes 443 and 447 can be formed on the top surface of bottom binder 446. Otherwise the structure and operation of the antenna shown in FIG. 4 is similar to that shown in FIG. 3B.

Figure 5:
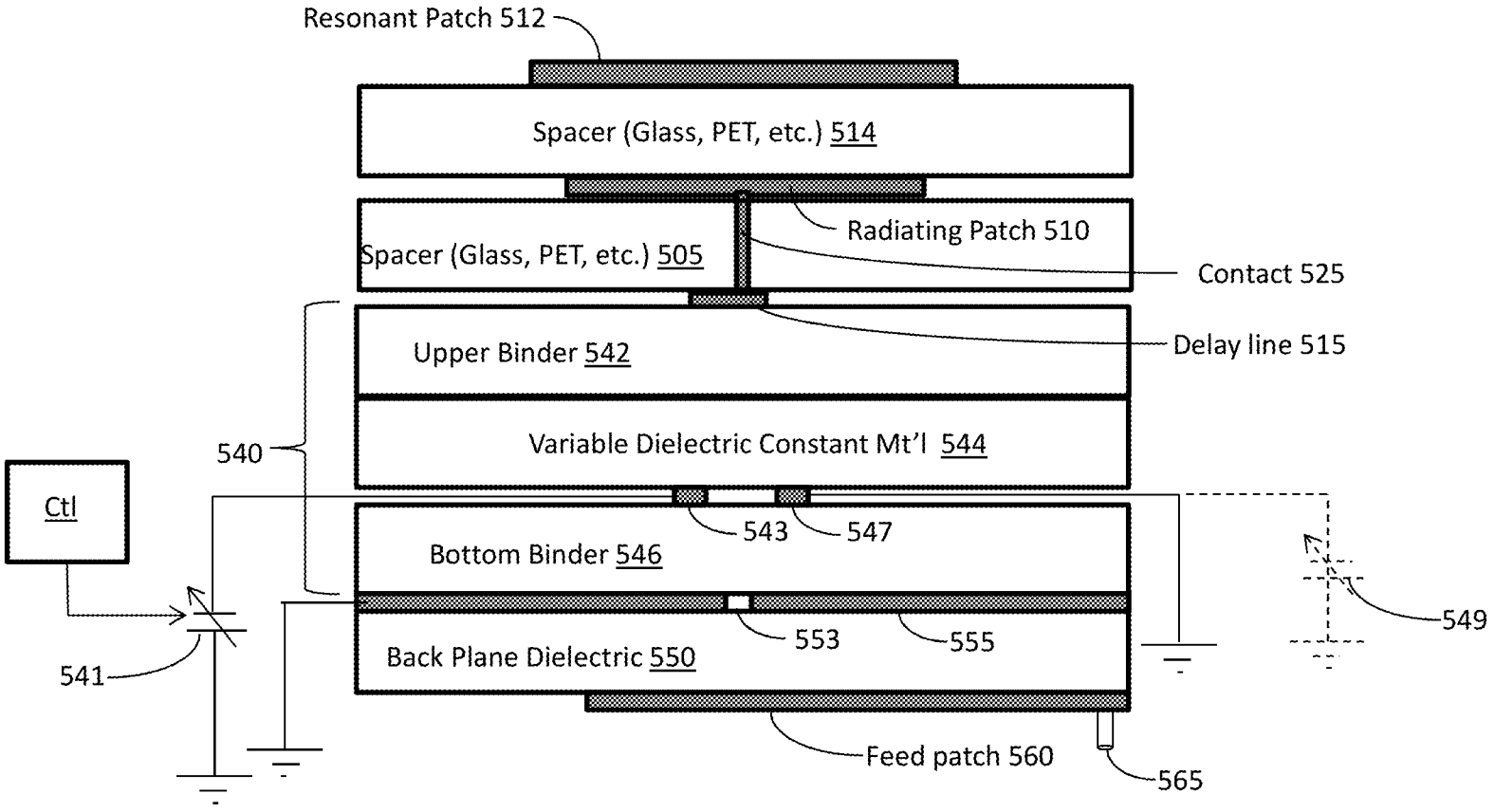
FIG. 5 illustrates a cross section of relevant sections of the antenna at the location of the radiating element according to another embodiment designed to provide enhanced bandwidth.

FIG. 5 illustrates another example designed to provide enhanced bandwidth. The general structure of the antenna of FIG. 5 can be according to any of the embodiments provided herein, except that another dielectric layer in the form of spacer 514 is provided over the radiating patch 510. A resonant path, 512, is formed on top of the spacer 514. Resonant patch 512 has the same shape as radiating patch 510, except that it is larger, i.e., has larger width and larger length, if it is a rectangle, or larger sides if it is a square. The RF signal is coupled between radiating patch 510 and resonant patch 512 capacitively across spacer 514. This arrangement provides a larger bandwidth than using just radiating patch 510.

Figure 6A:
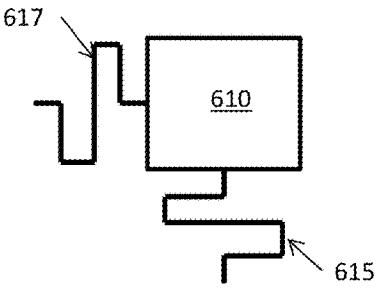
Figure 6B:
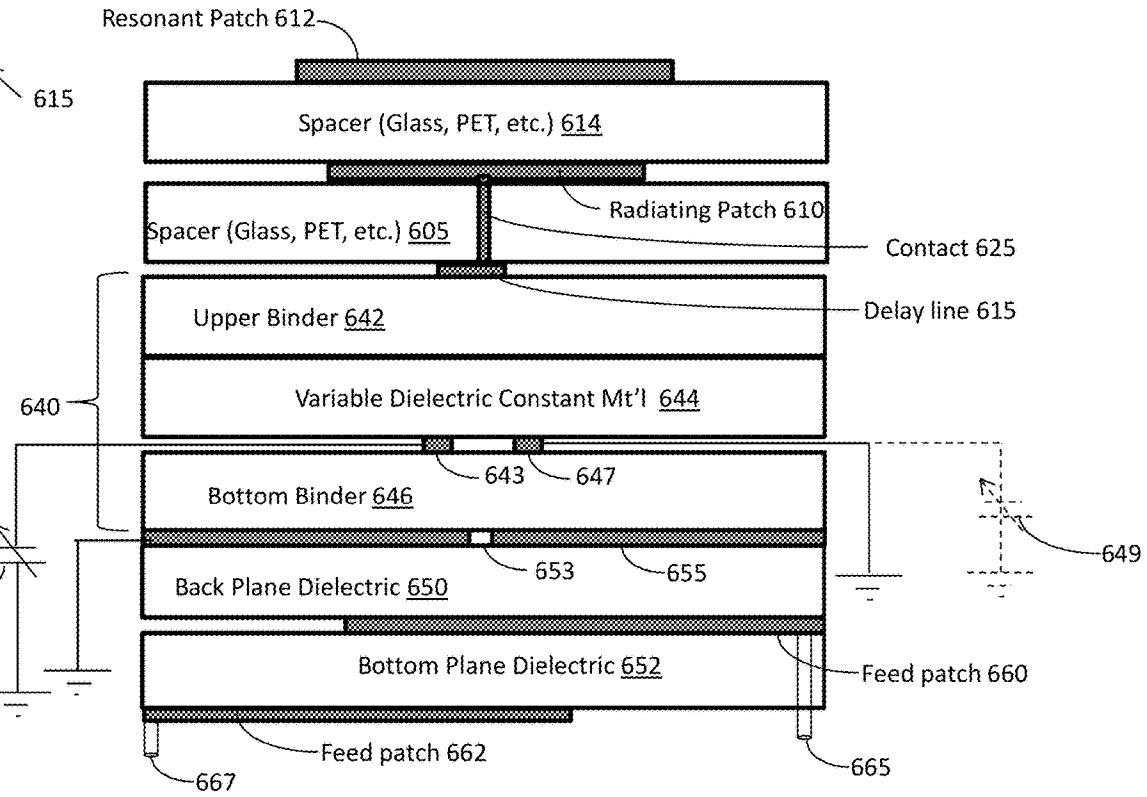
FIG. 6B illustrates a cross section of relevant sections of the antenna at the location of the radiating element of FIG. 6A, according to an embodiment having two delay lines connected to each patch, similar to what is shown in FIG. 2; while FIGS. 6C and 6D describe embodiments that have the variable dielectric layer directly beneath the RF line and that the RF line is activated by an AC voltage through a BiasT, that is to provide a strong impact line as well as two layers for two different corporate feeding networks.

FIGS. 6A and 6B illustrate an embodiment having two delay lines connected to each patch, similar to what is shown in FIG. 2. In such an embodiment, each delay line may transmit in different polarization. A bottom dielectric 652 separates the two feed patches 660 and 662, each coupling signal to a respective one of the delay lines 615 and 617. The two feed patches 660 and 662 are oriented orthogonally to each other. The signal coupling is done capacitively through a window 653 in the conductive ground 655, as illustrated in the previous examples. In FIG. 6B only one window 653 is illustrated, since the other window is provided in another plane not shown in this cross section. However, the arrangement of two windows can be seen in FIG. 8. When implementing the split ground feature for this embodiment, the DC break can be made to delineate between the two delay lines, or may have the two delay lines on the same ground patch or ground row.

Figure 6C:
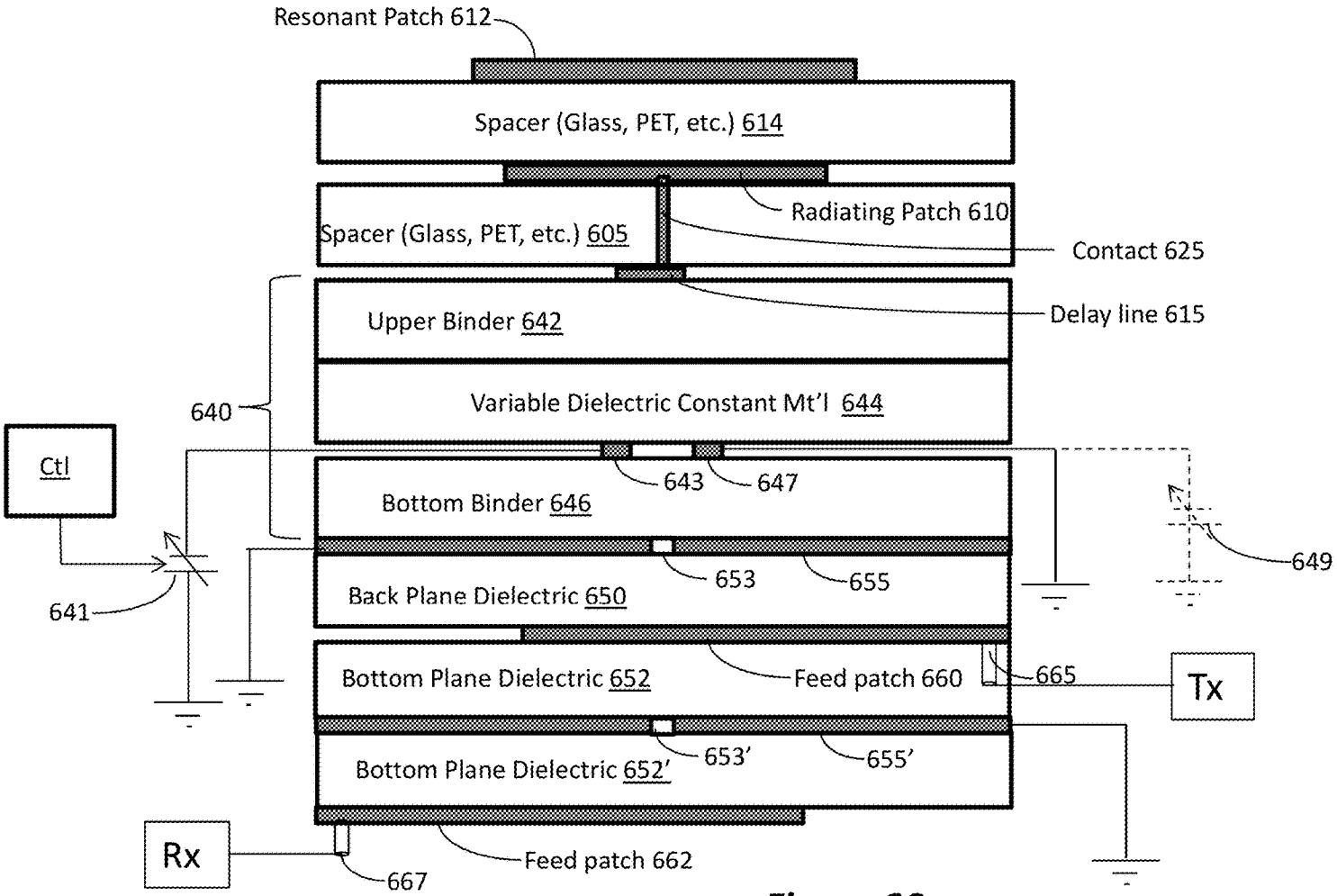

FIG. 6C illustrates another example of two orthogonal feed lines. In this particular example one feed line is used for transmission while the other is used for reception. While this embodiment is illustrated in conjunction with radiating patch 610 and resonant patch 612, this is not necessary and is used only for consistency of illustration with FIG. 6B. In the specific example of FIG. 6C feed patch 660 is provided on the bottom of backplane dielectric 650 and is coupled to a transmission line via connector 665. The signal from the transmission line 665 is coupled from feed patch 660 capacitively through the window 653 in conductive ground 655 to the radiating patch 610. A second conductive ground 655' with window 653' is provided on the bottom of bottom plane dielectric 652. In this embodiment it is sufficient to have conductive ground 655 as a split ground; however, alternatively both conductive grounds 655 and 655' may be split grounds. A second bottom plane dielectric 652' is provided below the second conductive ground 655', and feed patch 662 is provided on the bottom of the second bottom plane dielectric 652'. In this example, feed patch dielectric 662 is used for reception. In one example radiating patch 610 is square, so that the transmission and reception are performed at the same frequency, but may be at different polarization and/or phase. According to another example, the radiating patch 610 is rectangle (see FIG. 6E), in which case the transmission and reception may be done at different frequencies, which may be at the same and different polarization and/or phase.

Figure 6F:
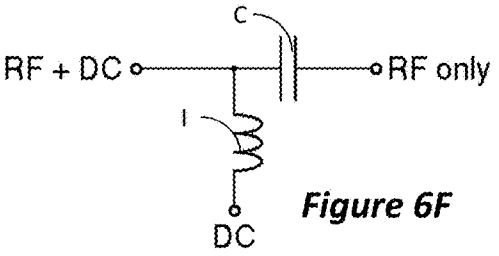
FIG. 6F illustrates a standard Bias-T circuit.
Figure 6E:
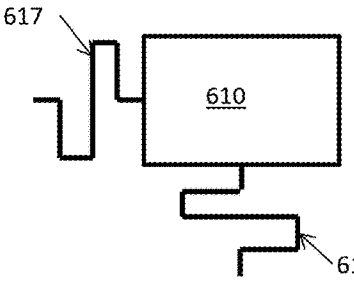
Figure 6D:
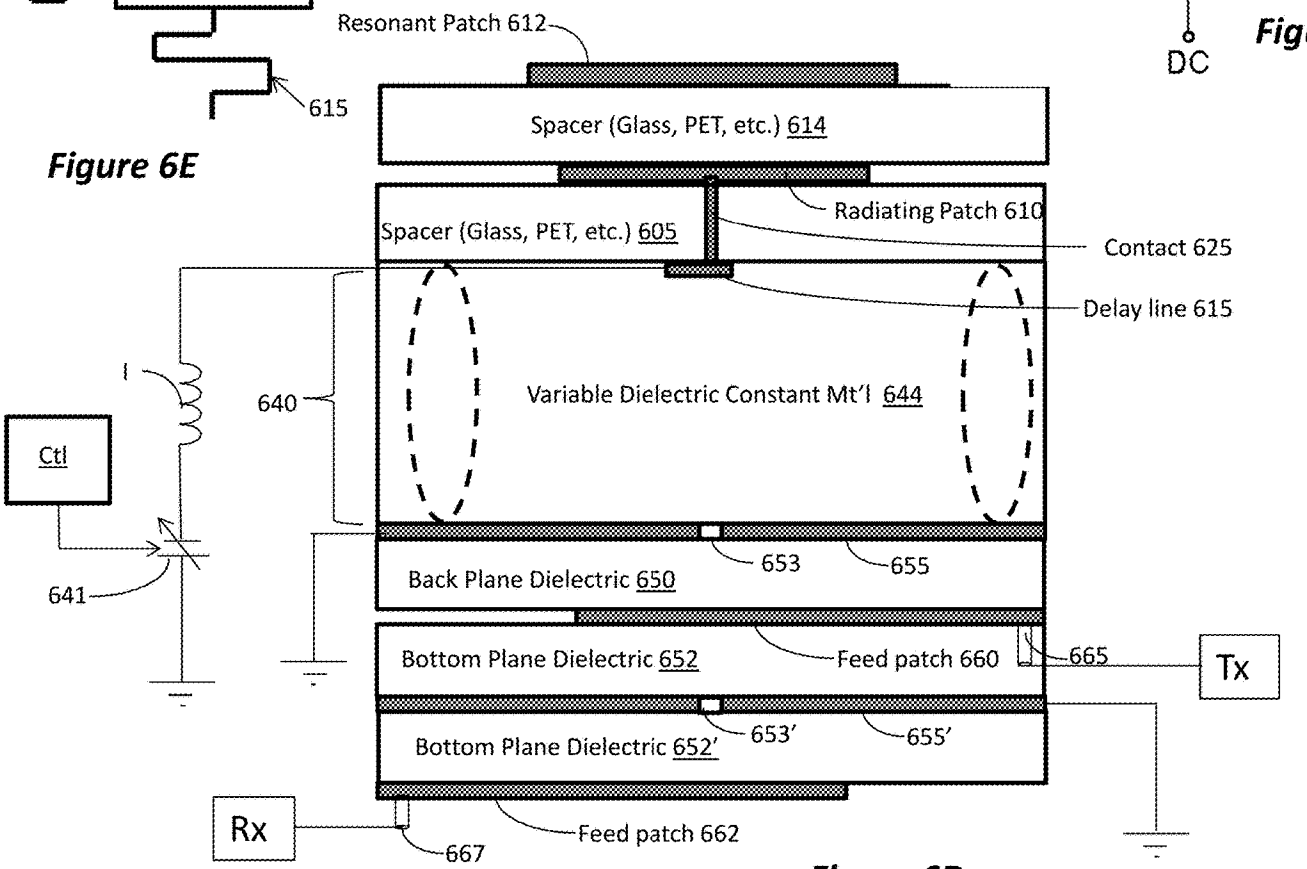

FIG. 6D illustrates another example where one feed patch is used for transmission and the other for reception. However, in FIG. 6D the control of the VDC material is done by feeding the DC potential to the delay line 615. This can be done, e.g., using a modified Bias-T arrangement. Specifically, FIG. 6F illustrates a standard Bias-T circuit. The RF+DC node corresponds to the delay line 615. The DC node corresponds to the output of the variable voltage potential 641. The RF node corresponds to feed patches 660 and 662. As shown in FIG. 6F, the RF node is coupled to the circuit via capacitor C. However, as explained herein, the RF signal in the disclosed embodiments is already coupled to the delay line capacitively, such that capacitor C may be omitted. Thus, by incorporating inductor I into the DC side of the antenna, a modified Bias-T circuitry is created. The common, or ground, signal can be applied to the conductive ground 655, which may be implemented as split ground according to any of the embodiments disclosed herein.

Another variation illustrated in FIG. 6D, but which can be implemented in any of the other embodiments, is the elimination of the binder layers. As shown in FIG. 6D, the VDC material is sandwiched between the spacer 605 and the back plane dielectric 650 with the conductive ground 655. In one example, glass beads (shown in broken line) can be interspersed within VDC material 644 so as to maintain the proper separation between the spacer 605 and the back plane dielectric 650 with the conductive ground 655. Of course, glass beads can also be used when using the binder layers.

Figure 7:
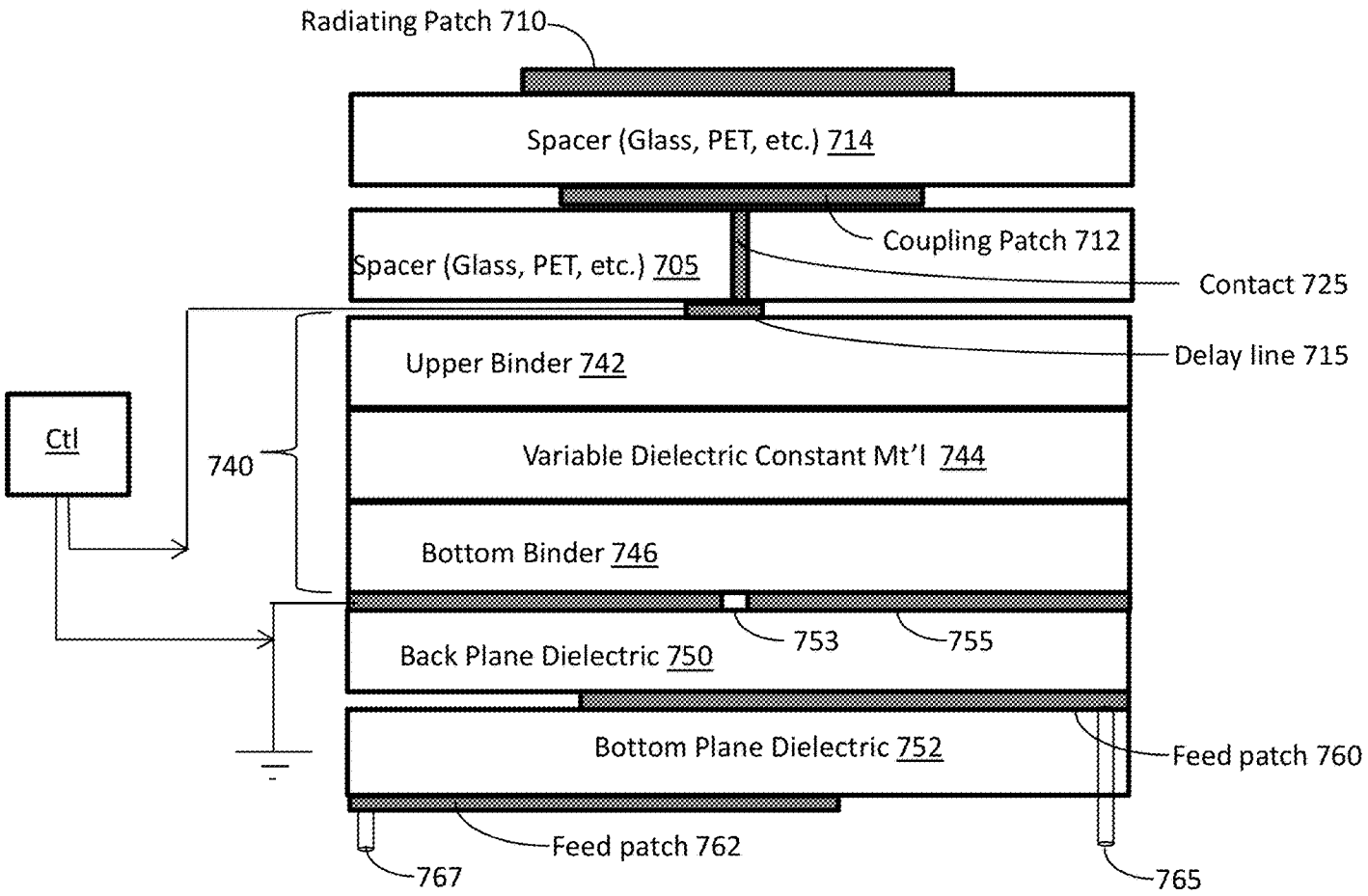
FIG. 7 illustrates an embodiment wherein the DC potential for controlling the variable dielectric constant material is applied to the delay line itself, such that no electrodes are needed.

FIG. 7 illustrates an embodiment wherein the DC potential for controlling the variable dielectric constant material is applied to the delay line itself, such that no electrodes are needed. A standard controller may be used, which provides an activation signal and a common signal to control each pixel. A bias-t may be used to separate the RF and activation signals. The output of the controller Ctl coupled (e.g., via bias-t) to the delay line 715, establishing a DC potential between delay line 715 and backplane conductive ground 755. The backplane conductive ground 755 may be a split ground, as disclosed in the above embodiments, such that the common signal of the controller is applied to a ground strip or a ground patch, depending on the split ground utilized. Consequently, the delay line has two functions: it accepts the DC voltage potential to thereby change the dielectric constant of the VDC material 744, and it capacitively couples RF signal to the feed patches 760 and 762.

As can be understood from the disclosure of the embodiments, various antennas may be constructed having the common elements comprising: an insulating spacer; at least one radiating arrangement provided on the insulating spacer, wherein each radiating arrangement comprises a conductive patch provided on the top surface of the insulating spacer, a delay line provided on the bottom surface of the insulating spacer, and a contact made of conductive material and providing electrical DC connection between the conductive patch and the delay line via a window in the insulating spacer; a variable dielectric constant (VDC) plate; a back plane insulator; a back plane conductive ground provided over the top surface of the back plane insulator; and an RF coupling arrangement for each of the at least one radiating arrangement, the RF coupling arrangement comprising a window formed in the back plane conductive ground and a conductive RF feed patch provided over the bottom surface of the back plane insulator in an overlapping orientation to the window. In some embodiments electrodes are provided in order to control the dielectric constant at selected areas of the VDC plate, while in others the delay line is used for this purpose. In some embodiments the conductive patch is used to couple RF signal from the air, while in others it is used to couple RF energy to another, larger, patch which is used to couple RF signal from the air. The size of the patch is configured according to the desired RF wavelength. The RF wavelength can also be used to optimize the RF coupling by properly sizing the window, the delay line, and the feed patch.

Figure 9A:
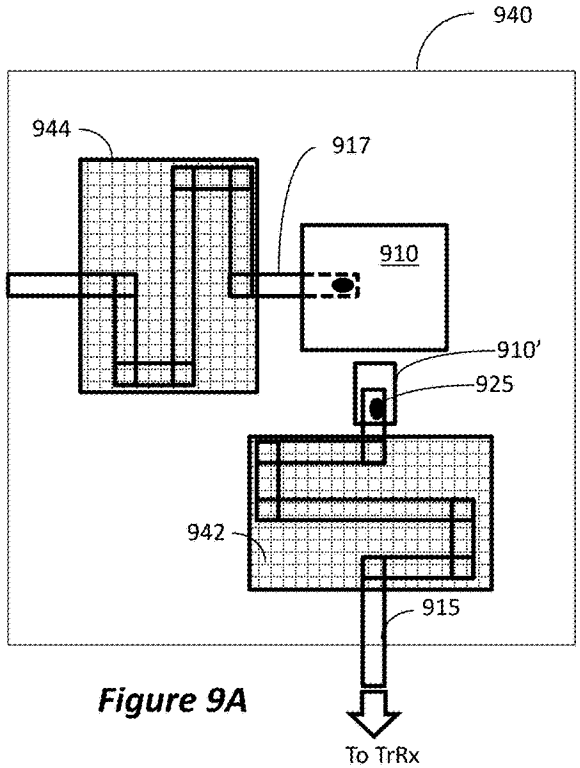
FIG. 9A illustrates a variation of the embodiment shown in FIG. 9.
Figure 9:
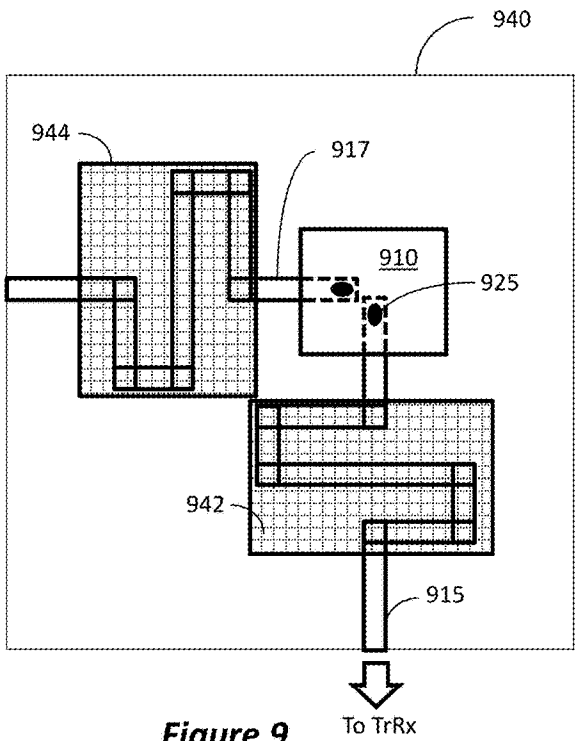

The VDC plate may be segmented into individual pixels of VDC material. An LCD panel of a flat panel screen may be used for the VDC plate. VDC pixels may be grouped according to the area coverage of the electrodes or the delay lines. In other embodiments the VDC material is provided only in areas controlled by the electrodes or delay line. FIG. 9 illustrates an example wherein the VDC plate 940 includes only defined area of VDC material. VDC area 942 is shown under delay line 915 and VDC area 944 is shown under delay line 917. Each of VDC areas may be one continuous area of VDC material or may be divided into pixels. For ease of production the entire area of VDC plate 940 may include pixels of VDC material. FIG. 9A illustrates capacitive coupling of the delay line 915 to the radiating patch 910 through coupling patch 910', similar to that shown in FIG. 8A, but otherwise it is the same as shown in FIG. 9.

Figure 10:
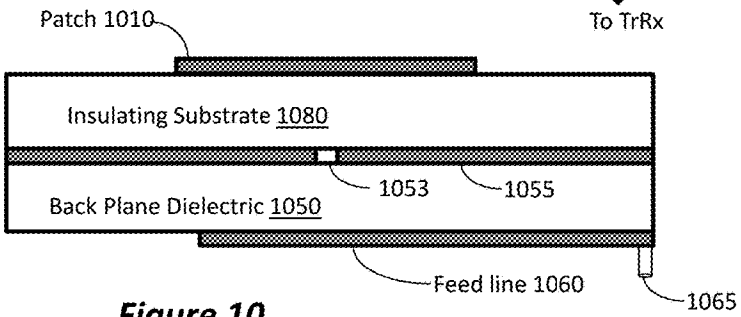
FIG. 10 illustrates an embodiment wherein no VDC plate is used.

Features disclosed herein may be implemented to form an antenna even when no change in phase and/or frequency is needed. FIG. 10 illustrates an embodiment wherein no VDC plate is used. In the embodiment of FIG. 10, the antenna comprises an insulating substrate 1080 and the conductive patch 1010 is provided on the top surface of the insulating substrate 1080. A ground plane 1055 provided on the bottom surface of the insulating substrate 1080, the ground plane comprising an aperture 1053 therein. The aperture is registered to be aligned below the conductive patch 1010. A feed line 1060 has its terminative end thereof registered to be aligned below the aperture 1053, so as to capacitively transmit RF signal to the conductive patch 1010 through the aperture 1053. A back plane dielectric is provided between the ground plane 1055 and the feed line 1060. A connector 1065 is used to transmit/receive RF signal to/from the feed line 1060.

Various embodiments were described above, wherein each embodiment is described with respect to certain features and elements. However, it should be understood that features and elements from one embodiment may be used in conjunction with other features and elements of other embodiments, and the description is intended to cover such possibilities, albeit not all permutations are described explicitly so as to avoid clutter.

Generally, a multi-layer, software controlled antenna is provided. The antenna comprises a radiating patch over an insulator plate. A delay line is provided on the bottom of the insulator plate and has one end thereof RF coupled to the radiating patch. The electrical coupling may be by physical conductive contact or by proximity coupling without physical conductive connection therebetween. A variable dielectric constant (VDC) plate is provided below the delay line. A ground plane is provided on bottom of VDC plate, the ground plane comprising an aperture therein, the aperture being registered to be aligned below the radiating patch. A feed line having terminative end thereof registered to be aligned below the aperture is provided below the ground plane, so as to capacitively transmit RF signal to the conductive patch through the aperture. An electrical isolation is provided between the feed line and the ground plane. For example, a back plane dielectric plate may be provided between the feed line and the ground plane. In some embodiments a second feed line is provided, which may coupled RF signal to the delay line through another aperture provided in the ground plane, or through a second, separate ground plane.

To obtain an enhanced bandwidth, a resonant patch may be provided over the radiating patch, wherein in some embodiments an insulating spacer may be provided between the radiating patch and the resonant patch. In some embodiments electrodes are provided in the VDC plate. The electrodes are coupled to variable voltage potential source, which may be connected to a controller. In other embodiments the VDC plate is controlled by applying DC potential to the delay line. Applying a DC potential to the delay line may be implemented using a modified Biat-T, wherein the feed line, ground plate, VDC plate, and delay line form the RF leg of the Bias-T circuitry. The DC leg may be coupled to the delay line through an intermediate inductor (see FIG. 6D). The ground plane may be a split ground plane.

It should be understood that processes and techniques described herein are not inherently related to any particular apparatus and may be implemented by any suitable combination of components. Further, various types of general purpose devices may be used in accordance with the teachings described herein. The present invention has been described in relation to particular examples, which are intended in all respects to be illustrative rather than restrictive. Those skilled in the art will appreciate that many different combinations will be suitable for practicing the present invention.

Moreover, other implementations of the invention will be apparent to those skilled in the art from consideration of the specification and practice of the invention disclosed herein. Various aspects and/or components of the described embodiments may be used singly or in any combination. It is intended that the specification and examples be considered as exemplary only, with a true scope and spirit of the invention being indicated by the following claims.

The invention claimed is:

1. A multi-layer antenna comprising:

a radiating layer comprising a plurality of radiating patches provided on a top surface of an insulating spacer and arranged in an array of row and columns;

a transmission layer comprising a plurality of delay lines arranged in an array of row and columns, each delay line being coupled to one of the radiating patches;

a control layer comprising a variable dielectric constant (VDC) plate;

an RF coupling arrangement for coupling RF signal to each of the radiating patches; and, a ground layer comprising a plurality of conductive ground patches, each conductive ground patch separated from a neighboring conductive ground patch by a DC break sized to form a short for ground path of the RF signal.

2. The antenna of claim 1, wherein each radiating patch is fed by two orthogonal delay lines.

3. The antenna of claim 1, further comprising a controller applying a common signal to each of the ground patches.

4. The antenna of claim 1, wherein each of the delay lines is coupled to an RF source and to a DC voltage potential source.

5. The antenna of claim 4, further comprising a plurality of bias-T circuits, each coupling one of the delay lines to the DC voltage potential source.

6. The antenna of claim 1, wherein the width of the DC break is not more than $\lambda/10$ with respect to the wavelength of the RF signal.

7. The antenna of claim 1, wherein the ground layer further comprises a plurality of apertures, each aperture being aligned with one of the conductive delay lines.

8. The antenna of claim 1, wherein the RF coupling arrangement comprises proximity coupling between each of the delay lines and the respective radiating patch.

9. The antenna of claim 1, wherein the RF coupling arrangement comprises a plurality of conductive vias formed in the insulating spacer, each electrically connecting one of the delay lines to one of the radiating patches.

10. The antenna of claim 1, wherein each of the conductive ground patches is aligned to a single one of the delay lines.

11. The antenna of claim 8, wherein all of the conductive ground patches cooperatively form a common ground for the RF signal.

12. The antenna of claim 1, wherein the RF coupling arrangement comprises a plurality of feed lines.

13. The antenna of claim 12, wherein each of the conductive ground patches comprises at least one aperture aligned to one of the conductive delay lines and one of the feed lines.

14. The antenna of claim 1, wherein the RF coupling arrangement comprises:

a plurality of feed lines, each coupling RF energy to one of the delay lines; and, a plurality of conductive vias formed in the insulating spacer, each electrically connecting one of the delay lines to one of the radiating patches.

15. The antenna of claim 1, wherein the VDC plate comprises a plurality of pixels, and further comprising a controller generating a plurality of square-wave control signals applied to the pixels and a plurality of ground signals applied to the conductive ground patches.

16. The antenna of claim 1, further comprising a controller generating a plurality of square-wave control signals applied to the delay lines and a plurality of ground signals applied to the conductive ground patches.

17. The antenna of claim 15, wherein the VDC plate comprises an LCD screen.

18. The antenna of claim 1, wherein each radiating patch is fed by two orthogonal delay lines, and wherein the RF coupling arrangement comprises:

a first layer of feeding lines coupled to delay lines of first orientation;

a second layer of delay lines coupled to delay lines of orthogonal orientation to the delay lines of first orientation; and, a bottom dielectric positioned between the first layer of feeding lines and the second layer of feeding lines.

19. The antenna of claim 18, further comprising a second ground layer positioned between the first layer of feeding lines and the second layer of feeding lines.

20. The antenna of claim 1, wherein the RF coupling arrangement comprises:

a plurality of coupling patches, each fabricated next to one of the radiating patches but separated from the radiating patch by a dielectric space;

a plurality of conductive vias formed in the insulating spacer, each electrically connecting one of the delay lines to one of the coupling patches.

* * * * *